US008582993B2

(12) United States Patent
Murayama et al.

(10) Patent No.: US 8,582,993 B2
(45) Date of Patent: Nov. 12, 2013

(54) IMAGE FORMING APPARATUS THAT CHANGES A PERMISSIBLE RANGE OF A CORRECTION VALUE

(75) Inventors: Kentaro Murayama, Kasugai (JP); Osamu Takahashi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 201 days.

(21) Appl. No.: 13/072,823

(22) Filed: Mar. 28, 2011

(65) Prior Publication Data

US 2011/0318032 A1 Dec. 29, 2011

(30) Foreign Application Priority Data

Jun. 28, 2010 (JP) ..... 2010-146582

(51) Int. Cl.
*G03G 15/00* (2006.01)
*G03G 15/01* (2006.01)
*G03G 21/00* (2006.01)

(52) U.S. Cl.
USPC ..... 399/49; 399/81; 399/301

(58) Field of Classification Search
USPC ..... 399/49, 301, 81; 347/116
See application file for complete search history.

(56) References Cited

U.S. PATENT DOCUMENTS

| | | | | |
|---|---|---|---|---|
| 6,335,747 | B1 | 1/2002 | Munakata | |
| 2008/0118257 | A1 | 5/2008 | Murakami | |
| 2008/0279599 | A1 * | 11/2008 | Nagatsuka | 399/301 |
| 2010/0086317 | A1 * | 4/2010 | Kadokura | 399/11 |

FOREIGN PATENT DOCUMENTS

| | | | |
|---|---|---|---|
| JP | H08-262829 | A | 10/1996 |
| JP | H11-119504 | A | 4/1999 |
| JP | H11-218989 | A | 8/1999 |
| JP | 2001-109218 | A | 4/2001 |
| JP | 2002-244393 | A | 8/2002 |
| JP | 2005-234454 | A | 9/2005 |
| JP | 2008-091966 | A | 4/2008 |
| JP | 2008-134417 | A | 6/2008 |
| JP | 2010-079125 | A | 4/2010 |

OTHER PUBLICATIONS

Japan Patent Office, Notification of Reasons for Refusal for Japanese Patent Application No. 2010-146582 (counterpart to above-captioned patent application), mailed Jul. 9, 2013.

Japan Patent Office, Decision on Rejection for Japanese Patent Application No. 2010-146582 (counterpart to above-captioned patent application), mailed Sep. 10, 2013.

* cited by examiner

*Primary Examiner* — Sophia S Chen
(74) *Attorney, Agent, or Firm* — Baker Botts L.L.P.

(57) ABSTRACT

An image forming apparatus is provided. The image forming apparatus includes: a manual acquiring unit which is configured to receive a user input to acquire a correction value; an image forming unit which is configured to form an image while adjusting at least one of positional deviation and density deviation of the image based on the correction value; and a changing unit which is configured to execute at least one of a first changing process of changing a permissible range of a correction value for positional deviation according to a status of a factor causing a change in a position of an image, and a second changing process of changing a permissible range of a correction value for density deviation according to a status of a factor causing a change in a density of an image.

13 Claims, 9 Drawing Sheets

FIG. 6

341

| THE NUMBER OF PRINTED PAGES | ASSUMED EXPANSION AMOUNT |
|---|---|
| 1 - 1000 | 0 |
| 1001 - 2000 | 2 |
| 2001 - 3000 | 4 |
| 3001 - 4000 | 6 |
| 4001 - | 8 |

FIG. 7

342

| TEMPERATURE DIFFERENCE | ASSUMED EXPANSION AMOUNT |
|---|---|
| 0 - 10 | 0 |
| 11 - 15 | 1 |
| 16 - 20 | 2 |
| 21 - 25 | 3 |
| 26 - | 4 |

IMAGE FORMING APPARATUS THAT CHANGES A PERMISSIBLE RANGE OF A CORRECTION VALUE

CROSS-REFERENCE TO RELATED APPLICATION

This application claims priority from Japanese Patent Application No. 2010-146582, filed on Jun. 28, 2010, the entire subject matter of which is incorporated herein by reference.

TECHNICAL FIELD

Aspects of the present invention relate to an image forming apparatus that adjusts a position or density of an image based on a correction value input by a user.

BACKGROUND

An image forming apparatus performs an image adjustment so that a position or density of an image is not deviated. For example, an image forming apparatus has been known which receives a correction value input by a user through an operation panel or a printer driver and performs an image adjustment of adjusting positional deviation or density deviation based on the correction value when forming an image.

JP-A-2005-234454 describes a technique of acquiring the correction value by the user input, which includes printing a pattern image for positional deviation correction on a sheet and allows a user to determine and input a correction value based on a printing result thereof.

However, the above image forming apparatus has a following problem. That is, in the image forming apparatus that acquires the correction value by the user input, when the input correction value is considerably inappropriate, a quality of an image may be remarkably deteriorated.

SUMMARY

Accordingly, it is an aspect of the present invention to provide an image forming apparatus that can suppress performs an image adjustment based on a correction value input by a user and can suppress a quality of an image from being deteriorated.

According to an illustrative embodiment of the present invention, there is provided an image forming apparatus comprising: a manual acquiring unit which is configured to receive a user input to acquire a correction value; an image forming unit which is configured to form an image while adjusting at least one of positional deviation and density deviation of the image based on the correction value; and a changing unit which is configured to execute at least one of a first changing process of changing a permissible range of a correction value for positional deviation according to a status of a factor causing a change in a position of an image, and a second changing process of changing a permissible range of a correction value for density deviation according to a status of a factor causing a change in a density of an image.

According to the above configuration, there is provided an image forming apparatus that performs an image adjustment based on a correction value input by a user and can suppress a quality of an image from being deteriorated.

BRIEF DESCRIPTION OF THE DRAWINGS

The above and other aspects of the present invention will become more apparent and more readily appreciated from the following description of illustrative embodiments of the present invention taken in conjunction with the attached drawings, in which:

FIG. 6 shows a printed page number limiting table;

FIG. 7 shows a temperature limiting table;

DETAILED DESCRIPTION

Hereinafter, an image forming apparatus and an image forming system according to illustrative embodiments will be described with reference to the accompanying drawings. In the illustrative embodiments, the present invention is applied to a multi function peripheral (MFP) having a color printing function.

[Configuration of MFP]

Figure 1:
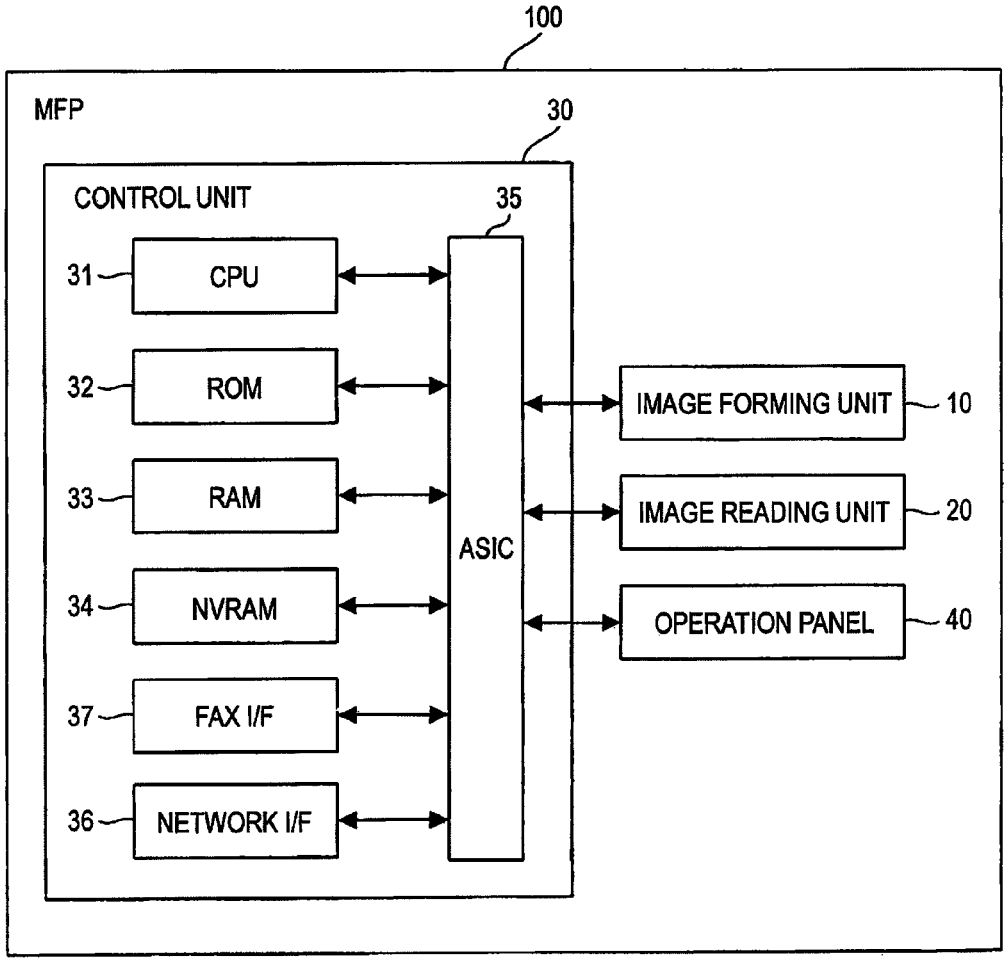
FIG. 1 is a block diagram showing an electrical configuration of an MFP.

As shown in FIG. 1, an MFP 100 of this illustrative embodiment includes a control unit 30 having a CPU 31, a ROM 32, a RAM 33, an NVRAM (non-volatile RAM) 34, an ASIC 35, a network interface 36 and a FAX interface 37. In addition, the control unit 30 is electrically connected to an image forming unit 10 that forms an image on a sheet, an image reading unit 20 that reads out an image of a sheet and an operation panel 40 that displays an operation situation and receives an input operation by a user.

The CPU 31 executes operations for implementing various functions such as an image reading function, an image forming function, a FAX data transmission/reception function and an image adjustment function (described later), and functions as a center of control. The ROM 32 stores therein various control programs for controlling the MFP 100, various settings, initial values and the like. The RAM 33 is used as a work area from which the various control programs are read out or a storage area that temporarily stores image data. The NVRAM 34 is a non-volatile storage device and is used as a storage area that preserves various settings, image data and the like.

Based on the control programs read out from the ROM 32 or signals transmitted from various sensors, the CPU 31 controls the respective constitutional elements of the MFP 100 (for example, a turn-on timing of an exposure device configuring the image forming unit 10, driving motors of various rollers configuring a conveyance path of a sheet and a moving motor of an image sensor unit configuring the image reading unit 20) through the ASIC 35 while storing results of the processing in the RAM 33 or NVRAM 34.

The network interface 36 is connected to a network and enables connection with the other information processing apparatuses. The FAX interface 37 is connected to a telephone line and enables connection with a FAX apparatus of the other party. The MFP 100 performs data communication with an external apparatus through the network interface 36 or FAX interface 37.

[Configuration of Image Forming Unit]

Figure 2:
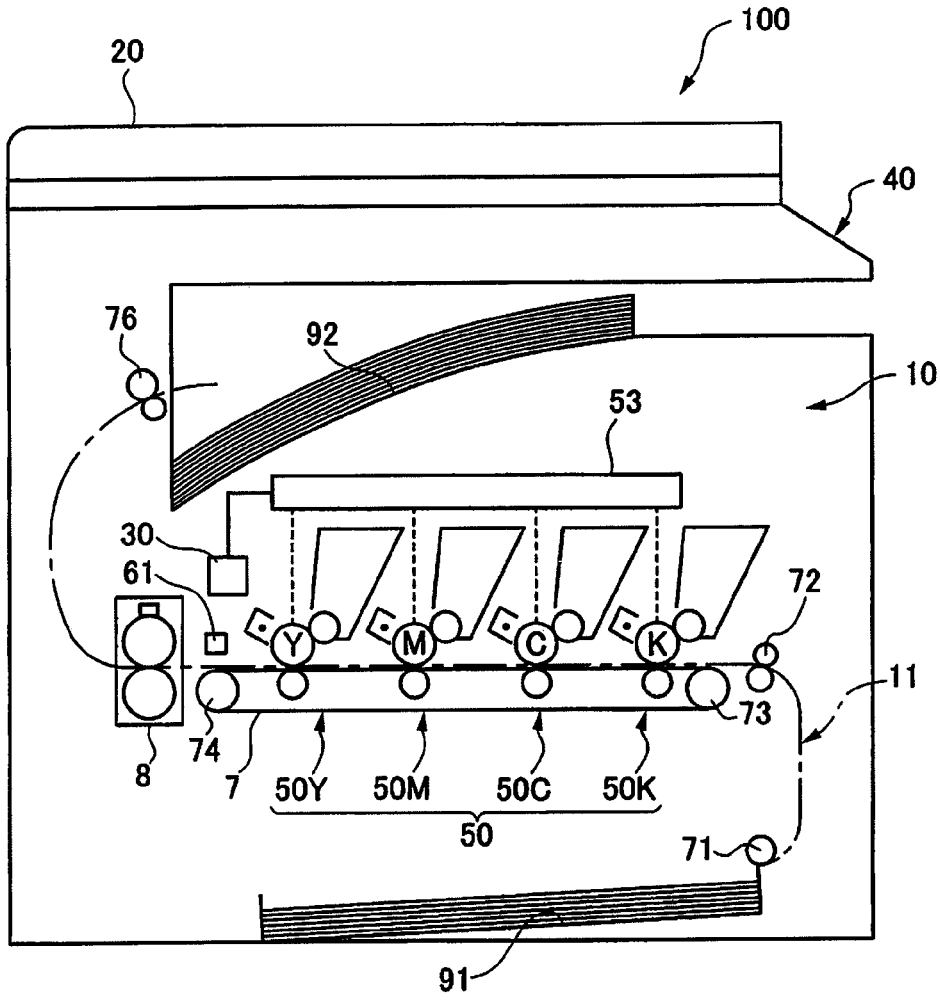
FIG. 2 shows a schematic configuration of an image forming unit of the MFP shown in FIG. 1.

Next, a configuration of the image forming unit 10 of the MFP 100 will be described with reference to FIG. 2. The image forming unit 10 has a process unit 50 that forms a toner image by an electro-photographic method and transfers the toner image on a sheet, a fixing device 8 that fixes unfixed toner on the sheet, a sheet feeding tray 91 that accommodates sheets therein before the image transfer and a sheet discharge tray 92 which receives sheets thereon after the image transfer. The image reading unit 20 is arranged above the image forming unit 10.

The image forming unit 10 has an exposure device 53 that illuminates light to the respective process units 50Y, 50M, 50C, 50K, a conveyance belt 7 that conveys a sheet to transfer positions of the respective process units 50Y, 50M, 50C, 50K and a mark sensor 61 that detects a pattern image formed on the conveyance belt 7.

In addition, the image forming unit 10 is provided therein with a conveyance path 11 (one dotted and dashed line in FIG. 2) having a substantial S shape so that the sheet accommodated in the sheet feeding tray 91 positioned at a bottom passes through a feeder roller 71, registration rollers 72, the process unit 50 and the fixing device 8 and is then guided to the sheet discharge tray 92 through sheet discharge rollers 76.

The process unit 50 can form a color image and includes the process units corresponding to respective colors of yellow (Y), magenta (M), cyan (C) and black (K) in parallel. Specifically, the process unit 50 has the process unit 50Y that forms an image of a Y color, the process unit 50M that forms an image of an M color, the process unit 50C that forms an image of a C color and the process unit 50K that forms an image of a K color. The respective process units 50Y, 50M, 50C, 50K are arranged at a predetermined interval in a conveyance direction of the sheet.

In the process unit 50, a surface of a photosensitive member is uniformly charged by a charging device. Then, the photosensitive member is exposed by the light from the exposure device 53 and an electrostatic latent image corresponding to an image formed on a sheet is thus formed on the photosensitive member. Then, toner is supplied to the photosensitive member through a developing device. Thereby, the electrostatic latent image on the photosensitive member becomes a visible image as a toner image.

The conveyance belt 7 is an endless belt member that is wound around the conveyance rollers 73, 74 and is made of a resin material such as polycarbonate and the like. The conveyance belt 7 is rotated in a counterclockwise direction as the conveyance roller 74 is rotated. Thereby, the sheet put on the conveyance belt is conveyed from the registration rollers 72 toward the fixing device 8.

The image forming unit 10 picks up the sheets accommodated in the sheet feeding tray 91 one by one and conveys the sheet onto the conveyance belt 7. Then, the image forming unit 10 transfers the toner image formed in the process unit 50 to the sheet. At this time, for a case of a color printing, toner images are formed by the respective process units 50Y, 50M, 50C, 50K and are then overlapped with each other on the sheet. In the meantime, for a case of a monochrome printing, a toner image is formed only by the process unit 50K and is then transferred on the sheet. Thereafter, the sheet on which the toner images are transferred is conveyed to the fixing device 8 and is then heat-fixed on the sheet. Then, the sheet after the fixing is discharged to the sheet discharge tray 92.

The mark sensor 61 is provided downstream from the process units 50Y, 50M, 50C, 50K and upstream from the fixing device 8 with respect to the conveyance direction of the sheet and detects a pattern for image adjustment formed on the conveyance belt 7.

Figure 3:
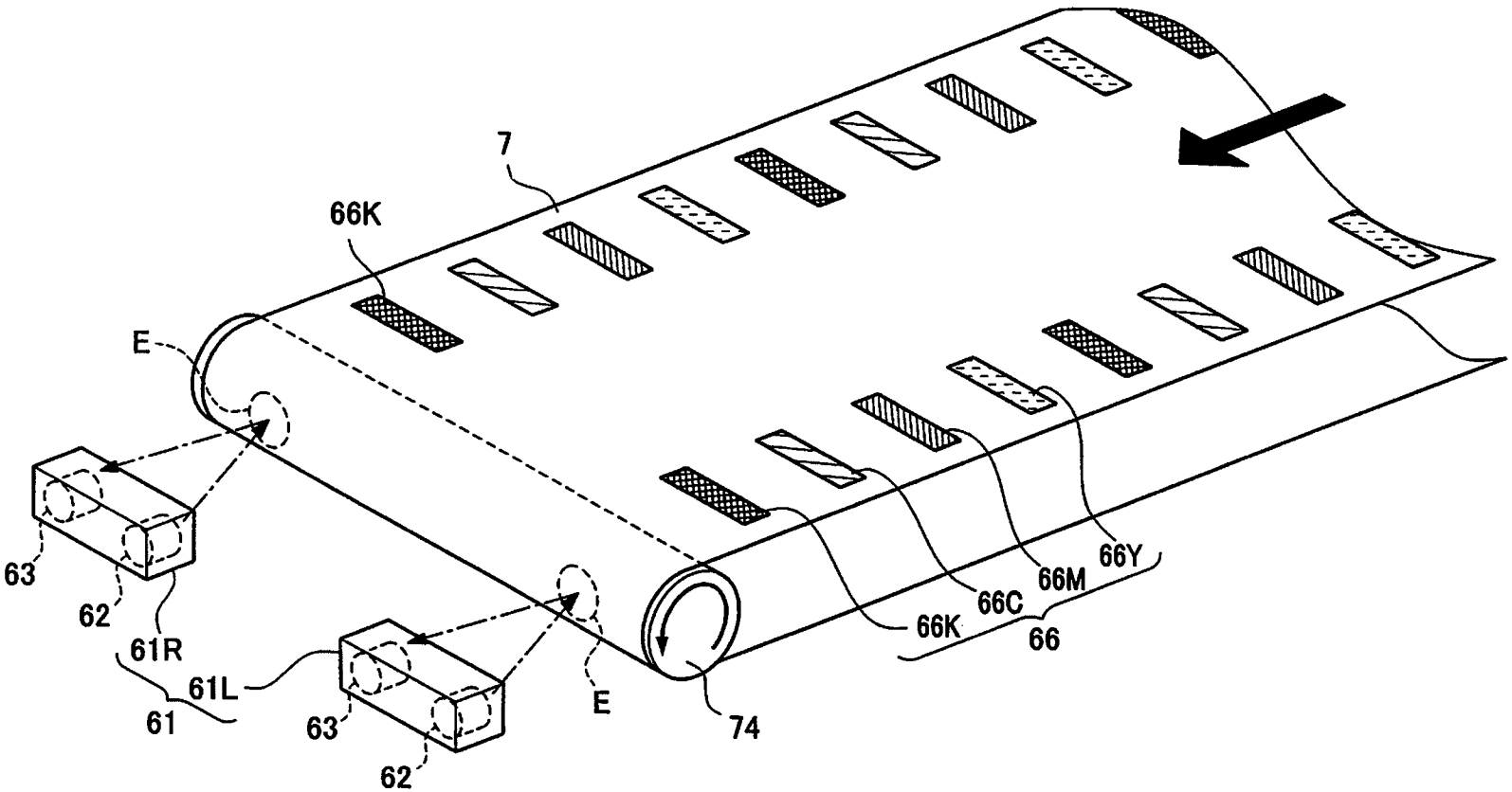
FIG. 3 shows an arrangement of mark sensors.

Specifically, as shown in FIG. 3, the mark sensor 61 includes two sensors, i.e., a sensor 61R that is arranged at a right side of a width direction of the conveyance belt 7 and a sensor 61L that is arranged at a left side thereof. Each of the sensors 61R, 61L is a reflection-type optical sensor having a pair of a light emitting element 62 (for example, LED) and a light receiving element 63 (for example, photo transistor). The mark sensor 61 illuminates light to a surface (dotted ranges E in FIG. 3) of the conveyance belt 7 in an oblique direction by the light emitting elements 62 and receives the light by the light receiving elements 63, respectively. The mark sensor can detect a mark 66 for image adjustment (mark 66 of FIG. 3 is an example of a mark for positional deviation correction) by a difference between an amount of reflection light received when the mark for image adjustment passes and an amount of reflection light received that is directly received from the conveyance belt 7.

[Image Adjustment in MFP]

Next, the image adjustment in the MFP 100 will be described. In the MFP 100, regarding the image adjustment, a positional deviation correction that adjusts positions of images of the respective colors and a density deviation correction that adjusts densities of the respective colors are performed. Both image adjustments include an acquiring process of acquiring amounts of deviation of adjustment colors from a reference color and acquiring correction values specified by the amounts of deviation and a correcting process of correcting an image based on the correction values. Hereinafter, the image adjustment will be described with reference to the positional deviation correction.

First, the acquiring process of the positional deviation correction will be described. The MFP 100 has two modes of acquiring process, which includes an automatic correction and a manual correction. The automatic correction is to adjust an image to an ideal position that is set for the MFP 100. The manual correction is to reflect a user's preference or to substitute for the automatic correction when the automatic correction does not function properly.

In the automatic correction, a registration pattern that is a pattern image for detecting an amount of positional deviation and the mark sensor 61 detects the registration pattern and thus calculates an amount of deviation. A correction value based on the amount of deviation is automatically acquired. In the manual correction, a user inputs a numerical value through the operation panel 40, so that a correction value is manually acquired.

Here, a sequence of acquiring the correction value in the automatic correction will be described. First, when a predetermined execution condition is satisfied, registration patterns for positional deviation correction are formed by the respective process units 50Y, 50M, 50C, 50K. The execution condition is determined based on an elapsed time period after a previous acquiring process, the number of printed pages, environmental changes such as temperature and humidity and a remaining amount of toner, for example.

Specifically, as shown in FIG. 3, the registration pattern 66 includes a mark group which has a mark 66K formed by the process unit 50K, a mark 66C formed by the process unit 50C, a mark 66M formed by the process unit 50M and a mark 66Y formed by the process unit 50Y, which are arranged in a sub-scanning direction.

The registration pattern 66 is formed at a constant interval in the sub-scanning direction (a moving direction of the conveyance belt 7 shown in FIG. 3). Each of the marks 66K, 66C, 66M, 66Y has a rectangular rod shape and is long in a main scanning direction (direction perpendicular to the sub-scanning direction).

Next, based on digitized signals output from the mark sensor 61, positions of the respective marks 66K, 66Y, 66M, 66C are detected. Then, intervals of marks (for example, marks 66C, 66M, 66Y) of respective adjustment colors relative to a mark of a reference color (for example, mark 66K) in the sub-scanning direction are respectively calculated. The intervals between the mark of the reference color and the adjustment colors are changed when positional deviation occurs in the sub-scanning direction. Therefore, it is possible to specify an amount of deviation of the adjustment color relative to the reference color in the sub-scanning direction. Based on the amount of deviation, a correction value by the automatic correction (hereinafter, referred to as "automatic correction value") is calculated. The automatic correction values are stored in the NVRAM 34.

It is noted that the configuration of the registration pattern 66 is just illustrative and is not limited to the above. The registration pattern may be a general image pattern that is used to correct the positional deviation. For example, the registration pattern may include a pair of two rod-shaped marks wherein at least one is inclined by a predetermined angle to a straight line following the main scanning direction. Such registration pattern can specify an amount of deviation in the main scanning direction as well as in the sub-scanning direction.

In the meantime, the manual correction is executed by a user's operation. The operation panel 40 is provided with a switch button for switching into a manual correction mode that enables an input of a correction value. A user pushes the switch button, inputs a desired correction value and then pushes an OK button. When the OK button is pushed, the MFP 100 acquires the input value to release the manual correction mode. Based on the input value, a correction value by the manual correction (hereinafter, referred to as "manual correction value") is calculated. The manual correction value is stored in the NVRAM 34.

The MFP 100 has a pattern printing function of printing a pattern image that is referred to when a user inputs a correction value. As the pattern image, a mark group as shown in FIG. 4A or 4B (hereinafter, referred to as "pattern image 86") is printed.

Figure 4A:
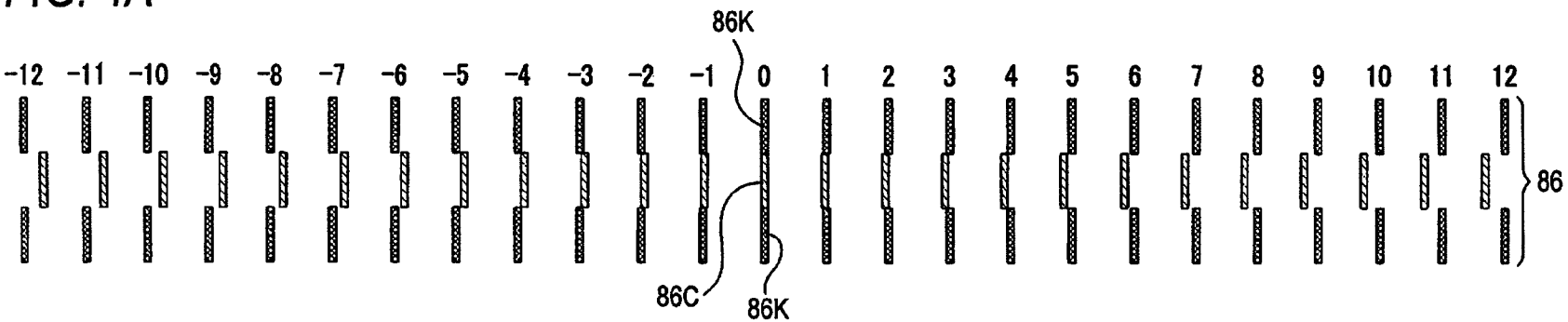
FIGS. 4A and 4B show a printing example of a pattern image.

In the pattern image 86 of this illustrative embodiment, marks of the same color having a rectangular rod shape are formed at a constant interval in the main scanning direction (horizontal direction in FIG. 4A). In the example of FIG. 4A, the reference color is black (K color) and the adjustment color is cyan (C color) and an interval of the marks 86C of the adjustment color are narrower than that of the marks 86K of the reference color by n dots (n is natural number and n=1 in this illustrative embodiment). The marks 86K of the reference color are formed as the number (25 in FIGS. 4A and 4B) corresponding to a permissible range of the manual correction value for the adjustment color and numbers (−12 to 12 in FIG. 4) corresponding to the permissible range are added in ascending order from the left. The marks 86C of the adjustment color is the same as the number of the marks of the reference color and a zero mark is printed so that its position of the main scanning direction is matched with a zero mark of the reference color. FIG. 4A shows a case where positional deviation does not occur and the mark of the reference color and the mark of the adjustment color are matched at a zero position.

Figure 4B:
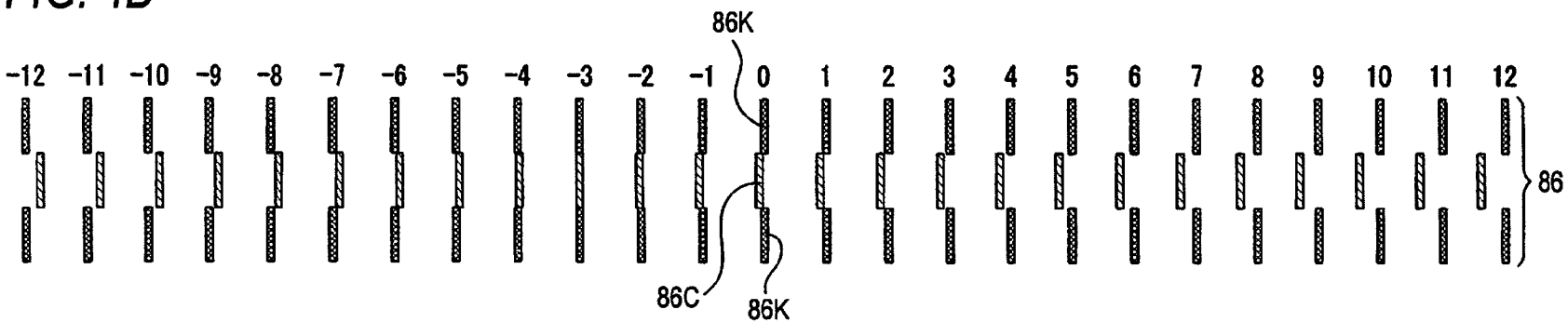

FIG. 4B shows a printing example where positional deviation occurs by 3 dots to the left. In this case, the mark of the reference color and the mark of the adjustment color are not matched at the zero position and are matched at −3 position. Thereby, a user can recognize that positional deviation of 3 dots occurs in the left. In this case, the user can adjust the positional deviation of the C color by inputting '3' as a correction value. When positional deviation of 3 dots occurs in the right, the user inputs '−3' as a correction value. In this illustrative embodiment, the K color is the reference color and the user can also input correction values for the M and Y colors in the same manner, in addition to the C color.

In the meantime, the configuration of the pattern image 86 is just illustrative and is not limited to the above. The pattern image may be a general image pattern that is used to correct the positional deviation. For example, the mark group including the pattern image 86 is formed at a constant interval in the sub-scanning direction (vertical direction in FIG. 4A), so that a user can check the positional deviation of the sub-scanning direction.

The printing of the pattern image 86 is executed when the switch button is pushed. Accordingly, a user can determine a correction value by referring to the sheet on which the pattern image 86 is printed. In the meantime, it may be also possible that the operation panel 40 is provided with a button for printing a pattern image and a user prints the pattern image 86 at any timing.

In the correction process, an actual correction value is determined by using the automatic correction value and the manual correction value, which are stored in the NVRAM 34. Based on the actual correction value, process conditions (for example, exposure position, speed of the conveyance belt 7 or photosensitive member) of the adjustment color are adjusted so that a position of an image of the adjustment color is matched with a position of an image of the reference color.

In the meantime, the density deviation adjustment also includes the automatic correction and the manual correction. For example, in the automatic correction, density patterns having density differences in the sub-scanning direction are formed by the respective process units 50Y, 50M, 50C, 50K. Then, amounts of reflected light from the density patterns are detected by the common sensor to the positional deviation correction or another optical sensor. In this illustrative embodiment, the detection is performed by the sensor 61L, for example. According to the amounts of reflected light, the densities are specified and differences with a target density are calculated as automatic correction values. In the manual correction, a manual correction value can be received through a user input. Then, in the correction process, an actual correction value is calculated based on the correction values, and the process conditions (for example, exposure intensity, exposure range and developing bias) of the respective colors are adjusted to maintain a target density based on the actual correction value.

[Sequence of Changing Permissible Range of Manual Correction Value]

The MFP 100 has a function of changing a permissible range of the manual correction value according to statuses of factors causing a change in a position or density of an image. In the following, a sequence of changing the permissible range of the manual correction value will be described together with a sequence of executing the positional deviation correction.

[Manual Acquiring Process]

Figure 5:
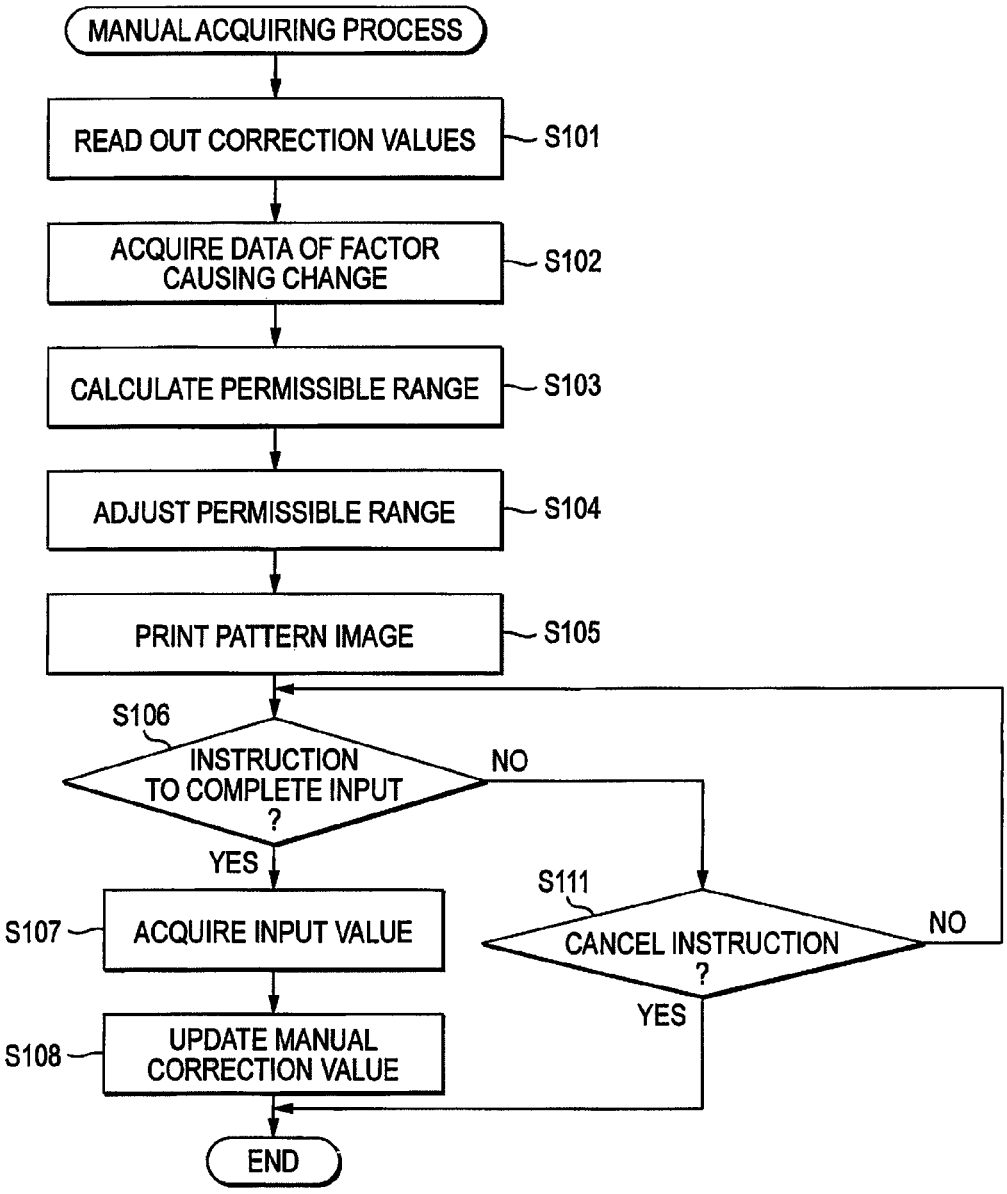
FIG. 5 is a flow chart showing a sequence of a manual acquiring process.

A sequence of the manual acquiring process that is an acquiring process for manual correction will be described with reference to a flow chart of FIG. 5. The manual acquiring process is executed by the CPU 31 when the switch button provided to the operation panel 40 is pushed.

First, the automatic correction value and the manual correction value are read out from the NVRAM 34 (S101). Then, data is acquired, which indicates the statuses of the factors causing a positional deviation of an image (S102). Specifically, the number of printed pages and the temperature in the apparatus are acquired.

Then, a permissible range of the manual correction value is calculated based on the data acquired in S102 (S103). In this illustrative embodiment, an initial value of a permissible range is stored in the ROM 32. In S103, an assumed expansion amount of positional deviation is calculated based on the data acquired in S102 and adds the assumed expansion amount to the initial value.

Specifically, the MFP 100 has a printed page number limiting table 341 that stores an assumed expansion amount a permissible range with respect to the number of printed pages, which is shown in FIG. 6, and a temperature limiting table 342 that stores an assumed expansion amount of a permissible range with respect to the temperature in the apparatus, which is shown in FIG. 7. 'The number of printed pages' is typically the number of printed pages from a previous update of the manual or automatic correction value. Accordingly, the number of printed pages from the previous update is reset when the automatic correction value is updated. In addition, the temperature limiting table 342 defines the assumed expansion amount for each of temperature differences between a reference temperature, which is a temperature in the apparatus at the time of the previous update, and the current temperature in the apparatus.

Then, the assumed expansion amount corresponding to the current number of printed pages and the assumed expansion amount corresponding to the current temperature in the apparatus, and both the assumed expansion amounts are summed up. For example, providing that the number of printed pages is 1,500 pages and the difference between the temperature in the apparatus and the reference temperature is 11 degree C., the assumed expansion amount '2' is acquired from the printed page number limiting table 341 and the assumed expansion amount '1' is acquired from the temperature limiting table 342, respectively. That is, the summed value '3' of both the assumed expansion amounts would be a total assumed expansion amount of positional deviation. Then, the permissible range of the manual correction value is determined while reflecting the total assumed expansion amount of positional deviation. For example, if −10 to 10 dots is an initial value of the permissible range, the permissible range would be −13 to 13 dots.

In the meantime, the parameter indicating the status of the factor causing the positional deviation in the image are not limited to the number of printed pages and the temperature in the apparatus. For example, an amount of change may be determined by ON time period, humidity in the apparatus, a remaining amount of toner, the number of times of opening and closing the cover and the like.

Further, regarding the method of acquiring the total assumed expansion amount of the positional deviation, in addition to the method of preparing tables corresponding to the respective factors and referring to the tables to acquire the assumed expansion amount for each of the factors, a calculation equation for calculating a total assumed expansion amount of positional deviation may be prepared and then a total assumed expansion amount of positional deviation may be calculated based on a plurality of factors. For example, a total assumed expansion amount of positional deviation may be calculated by a following equation (1).

$$\text{A total assumed expansion amount of positional deviation} = (C \times \text{the number of times of opening and closing the cover}) + (T \times \text{change in temperature}) + (B \times \text{the number of rotations of the belt driving droller}) + (S \times \text{maximum acceleration}) \quad (1)$$

In the equation, C, T, B and S are coefficients for calculating the individual expansion amounts of the respective factors. Specifically, C indicates an amount of positional deviation per one time of opening and closing the cover, T indicates an amount of positional deviation per unit temperature, B indicates an amount of positional deviation per one rotation of the driving roller 74 of the conveyance belt 7 and S indicates an amount of positional deviation per unit acceleration (unit voltage). The C, T, B and S may be fixed values or changed according to the other variables. In addition, the parameters applied to the equation (1) are not limited to the number of times of opening and closing the cover and the like.

In addition, the permissible range of the manual correction value is determined for each of the adjustment colors. In other words, the more distant from the transfer point of the reference color, the amount of deviation tends to be greater, such as the speed difference of the conveyance belt 7, the temperature difference in the apparatus and the like. Therefore, the more distant from the reference color, the permissible range is set to be larger. For example, in this illustrative embodiment, the K color is the reference color and the adjustment colors are more distant from the K color in order of C, M and Y colors (refer to FIG. 2). Accordingly, '1' is added to the total expansion amount of positional deviation in the M color and '2' is added to the total expansion amount of positional deviation in the Y color. Thereby, when −10 to 10 dots are the initial value of the permissible range and the total expansion amount of positional deviation acquired from the respective tables is '3,' the permissible range of the C color is −13 to 13 dots, the permissible range of the M color is −14 to 14 dots and the permissible range of the Y color is −15 to 15 dots.

After calculating the permissible ranges in S103, the permissible range is adjusted by using the current automatic and manual correction values that are acquired in S101 (S104). For example, providing that an image adjustment of '−3 dots' is performed based on the current actual correction value calculated by the automatic and manual correction values, when the permissible range acquired in S103 is −12 to 12 dots, an actual correctable range is −9 to 15 dots. Accordingly, when −10 is input, for example, since the shift of '−3 dots' has been already scheduled, the total amount of correction would be −13, which exceeds the permissible range. Thus, in this illustrative embodiment, the permissible range is adjusted to '−9 to 15 dots' so that a value equal to or smaller than '−10' cannot be input.

After that, the pattern image 86 is printed on a sheet (S105). The number of marks of each color in the pattern image 86 is different according to the permissible ranges determined in S103. In addition, since the adjustment is performed on the basis of the current correction value in S104, the number of marks may be different in positive and negative sides.

Figure 8:
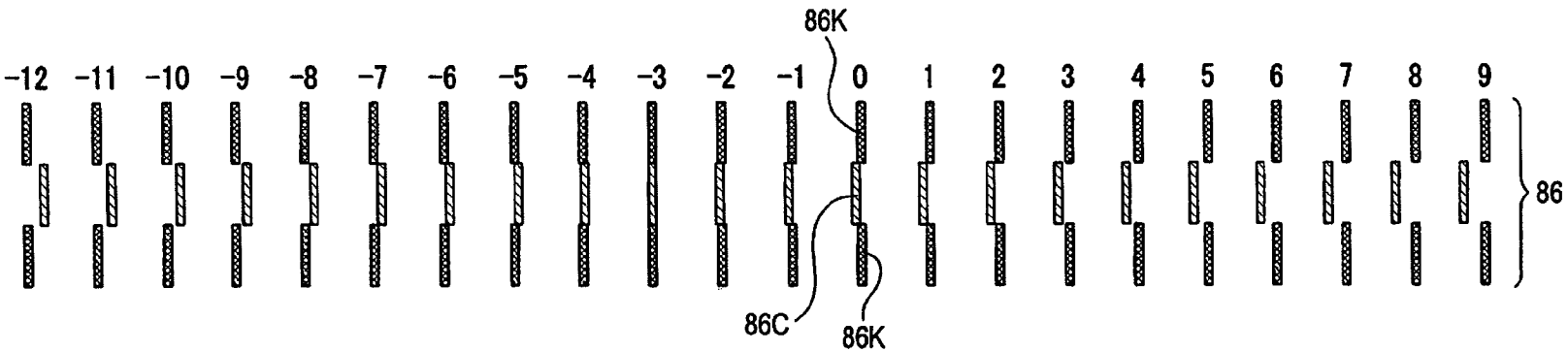
FIG. 8 shows a printing example of a pattern image on which a current correction value is reflected.

In the above example, by the adjustment in S104, the negative number side is limited up to −9, and the marks are printed up to −9, so that it is expected that an inappropriate numerical value is prevented from being input. However, when the positive number side is printed up to 15, it may cause a user to misunderstand that a numerical value within a range of −15 to 15 dots can be input. Accordingly, the number of marks to be printed is made to be within the range determined in S103 (−12 to 12 dots in the above example). In other words, in the above example, as shown in FIG. 8, marks of −9 to 12 are printed. After S105, an input of a correction by a user is waited. The user inputs a correction value with the operation panel 40.

After that, it is determined whether an instruction to complete the input of the correction value is input (S106). When an instruction to complete the input of the correction value is not input (S106: NO), it is determined whether a cancel instruction is input (S111). When a cancel instruction is also not input (S111: NO), the process returns to S106. When a cancel instruction is input (S111: YES), the manual acquiring process ends.

When an instruction to complete the input of the correction value is input (S106: YES), the input values of the respective adjustment colors are acquired, which are input as correction values (S107). Accordingly, the manual correction values of the respective adjustment colors are updated (S108). Specifically, the input value is added to the current manual correction value, and the result is stored in the NVRAM 34 as a new manual correction value. After S108, the manual acquiring process ends.

In the meantime, if a numerical value exceeding the permissible range has been input when an instruction to complete the input of the correction value is input, a message is issued indicating that there is a false input and again an input of a correction value is waited. Alternatively, when a numerical value exceeding the permissible range is input, the numerical value exceeding the permissible range may be replaced with a value which is most close to the input value but within the permissible range. Further, it may be prohibited to input a numerical value exceeding the permissible range at a step before an instruction to complete the input of the correction value.

[Automatic Correction Process]

Figure 9:
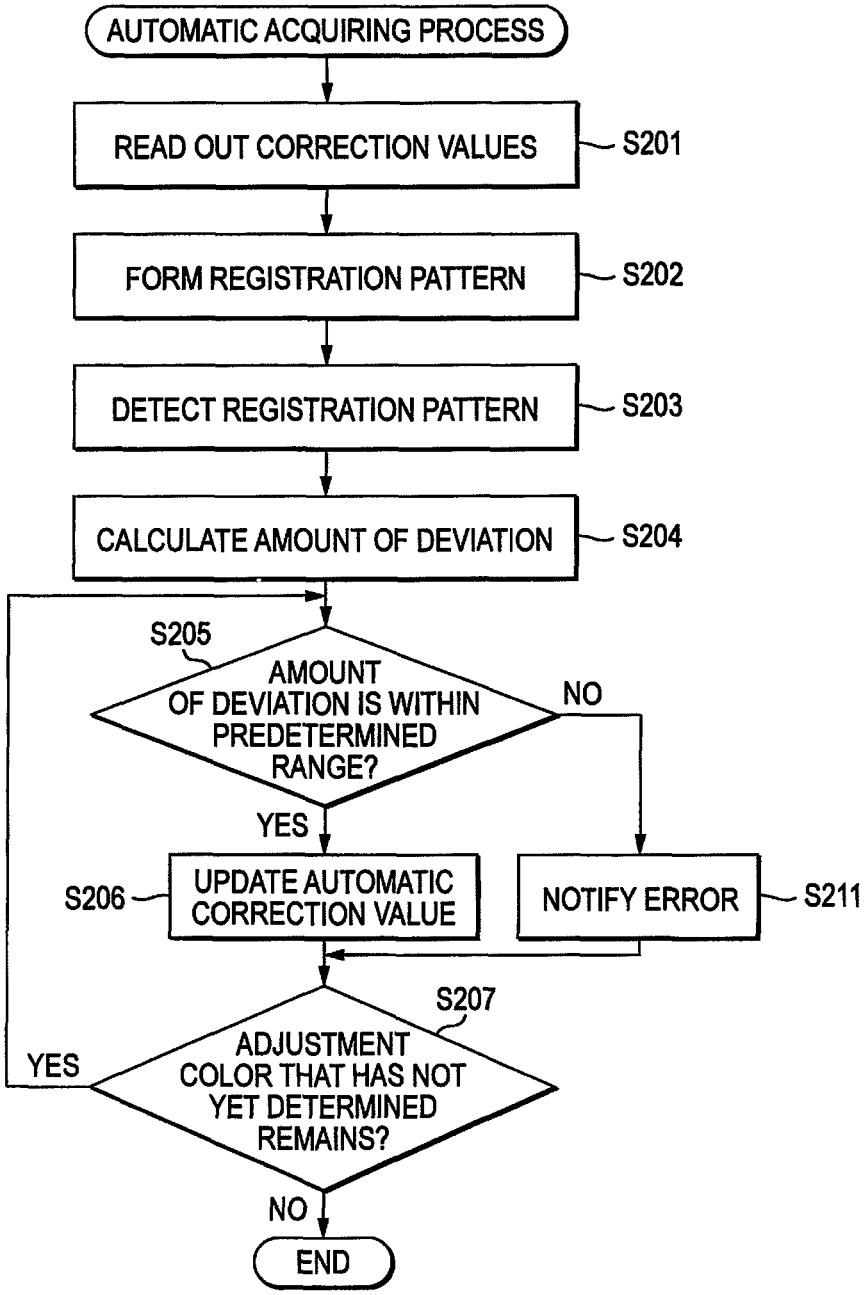
FIG. 9 is a flow chart showing a sequence of an automatic acquiring process.

Next, a sequence of the automatic acquiring process that is an acquiring process for automatic correction will be described with reference to a flow chart of FIG. 9. The automatic acquiring process is executed by the CPU 31 when an execution condition which is determined for automatic correction in advance is satisfied.

First, the automatic correction value and the manual correction value are read out from the NVRAM 34 (S201). The MFP 100 stores in the ROM 32, an amount of positional deviation before shipment from a factory, as an initial amount of deviation. The initial amount of deviation is an amount of positional deviation that is inherent to an apparatus measured for each apparatus when manufacturing the apparatus and is stored in the ROM 32 before shipment. The initial amount of deviation is set as the initial value of the automatic correction value. In other words, the automatic correction value is a value having the initial amount of deviation added thereto. In the meantime, zero (0) is set as an initial value of the manual correction value.

Then, the registration pattern 66 is formed on the conveyance belt 7 by using the automatic correction value and the manual correction value, which are read out in S201 (S202). Then, the mark sensor 61 detects the registration pattern 66 (S203). Then, the amounts of positional deviations of the respective adjustment colors are calculated based on signals from the mark sensor 61 (S204).

Then, it is determined whether the amount of positional deviation of each adjustment color, which is obtained in S204, is within a predetermined range (S205). The predetermined range is a range within which the positional deviation can be adjusted and is stored in the ROM 32 in advance. The case where the amount of positional deviation exceeds the predetermined range includes a case where the amount of positional deviation is so large that the adjacent marks are overlapped with each other, for example. This kind of large amount of positional deviation could be caused by an error input of the manual correction value by a user, which changes a position of a mark, for example. In addition, when the conveyance belt 7 has a damaged part and the mark sensor 61 falsely detects the damaged part as a mark, an inappropriate amount of positional deviation can be caused. Also, when the mark sensor 61 is out of order, even the amount of positional deviation itself cannot be acquired.

For an adjustment color having an amount of positional deviation that is within the predetermined range (S205: YES), the automatic correction value corresponding to the adjustment color is updated (S206). Specifically the amount of positional deviation acquired in S204 is added to the current automatic correction value, and the result is stored in the NVRAM 34 as a new automatic correction value. In the meantime, when the automatic correction value is updated, the number of printed pages is reset to zero. Accordingly, the assumed expansion amount with respect to the number of printed pages would be zero and the permissible range of the manual correction value is thus narrowed.

In the meantime, for an adjustment color having an amount of positional deviation that exceeds the predetermined range (S205: NO), an error is notified, which indicates that the automatic correction value is failed to be acquired (S211). The notification modes include message display on a display unit of the operation panel 40, generation of an alarm sound and writing of an error log, for example.

After S206 or S211, it is determined whether an adjustment color that has not yet determined is remaining in S205 (S207). When an adjustment color that has not yet determined is remaining (S207: YES), the process returns to S205 and determines the amount of positional deviation of the adjustment color that has not yet been determined. When the determination of S205 is completed for all adjustment colors (S207: NO), the automatic acquiring process ends.

[Printing Process]

Figure 10:
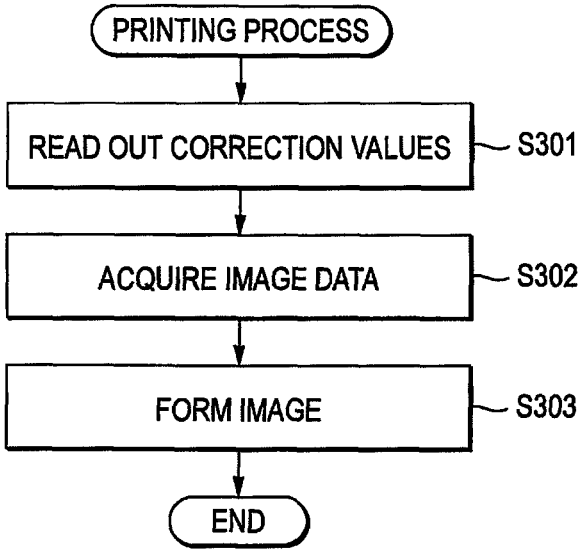
FIG. 10 is a flow chart showing a sequence of a printing process.

Next, a sequence of the printing process of printing image data will be described with reference to a flow chart of FIG. 10. The printing process is executed by the CPU 31 when a print instruction is received from the operation panel 40 or a print job is received from an information processing apparatus connected to the MFP 100.

First, the automatic correction value and the manual correction value are read out from the NVRAM 34 (S301). Then, image data to be printed is acquired (S302). The processes of S301 and S302 may be executed in a reverse order or at the same time.

Then, an actual correction value is determined by using both the automatic correction value and the manual correction value, which are read out in S301, and an image is formed while adjusting the process conditions of the adjustment colors so that positions of images of the adjustment colors are matched at positions of images of the reference color (S303). After S303, the printing process ends.

As described above, in the MFP 100 according to the illustrative embodiment, the permissible range is set for the manual correction value and is changed according to the factor (the number of printed pages, temperature in the apparatus and the like) causing a change in a subject of the image adjustment. When inputting the manual correction value, a value within the permissible range thereof is received, so that an appropriate manual correction value is acquired. In addition, when printing the pattern image 86, a pattern image suitable for the permissible range thereof is printed, so that it is expected that an appropriate manual correction value is input. As a result, it is possible to avoid acquiring an inappropriate correction value and to thus suppress a quality of an image from being deteriorated.

While the present invention has been shown and described with reference to certain illustrative embodiments thereof, it will be understood by those skilled in the art that various changes in form and details may be made therein without departing from the spirit and scope of the invention as defined by the appended claims.

For example, the image forming apparatus is not limited to the MFP. In other words, the inventive concept of the present invention can be applied to any apparatus having a printing function such as printer, copier, FAX apparatus and the like. In addition, the image forming apparatus is not limited to an electro-photographic type and may be an inkjet type. Further, the MFP 100 of the illustrative embodiment is a direct transfer tandem type. However, the MFP may be an intermediate transfer type or 4-cycle type.

In the above illustrative embodiment, the MFP has the color printing function. However, the inventive concept of the present invention can also be applied to a monochrome printing apparatus inasmuch as it performs the positional deviation correction or density deviation correction.

In the above illustrative embodiment, the pattern image is printed on the sheet when performing the manual acquiring process. However, a configuration of receiving an input from a user without performing such printing may be also possible. In addition, when printing the pattern image, a type of the sheet may be designated.

In the above illustrative embodiment, the actual correction value is determined by using the automatic correction value and the manual correction value. However, the present invention is not limited thereto. For example, it may be possible to determine an actual correction value without using the correction value having older update date between the automatic and manual correction values. In this case, the registration pattern 66 in the automatic correction or pattern image 86 in the manual correction are prepared without using the correction value having the older update date.

In the above illustrative embodiment, the permissible range is determined when switching to the manual correction mode or when printing the pattern image 86. However, the timing of changing the permissible range is not limited thereto. For example, it may be possible that a database, in which the permissible ranges is stored for each of the subjects (position and density of an image, for example) of the image adjustment, is provided and the permissible ranges corresponding to the subjects of the image adjustment are changed periodically or according to statuses of the factors causing a change in each subject of the image adjustment. In this case, when acquiring an input value by a user or printing the pattern image 86, the database storing the permissible ranges may be referred to, in order to determine whether to acquire it. In this configuration, the permissible ranges of the respective manual correction values, which are stored in the database, may be initialized when the automatic correction value of S206 is updated.

In the above illustrative embodiment, when printing the pattern image 86 on the sheet, the pattern image having different number of marks is printed according to the permissible range. However, the present invention is not limited thereto. For example, the interval between the marks may be changed according to the permissible range. In other words, when the permissible range is narrow, the interval between the marks is narrowed, and when the permissible range is wide, the interval between the marks is widened.

The present invention provides illustrative, non-limiting embodiments as follows:

An image forming apparatus includes: a manual acquiring unit which is configured to receive a user input to acquire a correction value; an image forming unit which is configured to form an image while adjusting at least one of positional deviation and density deviation of the image based on the correction value; and a changing unit which is configured to execute at least one of a first changing process of changing a permissible range of a correction value for positional deviation according to a status of a factor causing a change in a position of an image, and a second changing process of changing a permissible range of a correction value for density deviation according to a status of a factor causing a change in a density of an image.

The above image forming apparatus forms an image by using a correction value input by a user (manual correction value). According to a status of a factor causing positional deviation and density deviation, the image forming apparatus can change permissible ranges of the manual correction values corresponding to the deviations. Specifically, in the changing process, the image forming apparatus can execute at least one of the first changing process of changing a permissible range of a correction value for positional deviation according to a status of a factor causing a change in a position of an image and a second changing process of changing a permissible range of a correction value for density deviation according to a status of a factor causing a change in a density of an image. The factor causing the change in the position or density of an image may include an operation amount and environmental changes such as temperature and humidity.

That is, in the above image forming apparatus, there are permissible ranges of the manual correction values for each of subjects (position and density of an image, for example) of the image adjustment and the permissible ranges of the manual correction values corresponding to the subjects of the image adjustment are changed according to the statuses of the factors causing the change in the subjects of the image adjustment. Therefore, when inputting a correction value, a value within the permissible range thereof is received, so that an appropriate manual correction value can be acquired according to the statuses of the respective factors. Alternatively, when printing a pattern image that is referred to when inputting the manual correction value, a pattern image suitable for the permissible range thereof is printed and it can be thus expected that the appropriate manual correction value is input according to the statuses of the respective factors. As a result, it is possible to avoid acquiring an inappropriate correction value and to thus suppress a quality of an image from being deteriorated.

In the above, the changing unit may be configured to determine the permissible range by using a current correction value. When the correction value has been already acquired, a correctable range may be changed. Accordingly, it may be preferable to determine the permissible range based on the current correction value.

The above image forming apparatus may include: a limiting unit which is configured to limit an input range of the correction value by the manual acquiring unit based on the permissible range. The numerical value input range by the user input is limited based on the permissible range, so that it is possible to prevent an inappropriate correction value from being acquired in advance.

Further, the image forming unit may be configured to print on a recoding sheet a pattern image to be referred to when the user input is received by the manual acquiring unit to acquire the correction value. According to this configuration, it is possible to recognize an amount of deviation that actually occurs on the printing sheet and to input the manual correction value according to types of the sheet. Furthermore, the image forming unit may be configured to print a different pattern image according to the permissible range. The pattern image is changed according to the permissible range changed, so that it is possible to allow a user to recognize that the permissible range has been changed and to prevent an inappropriate value from being input.

Further, the image forming apparatus may further include an automatic acquiring unit which is configured to form a mark for detecting at least one of positional deviation and density deviation and acquire an amount of deviation by measuring the mark, and the changing unit may be configured to execute at least one of the first changing process and the second changing process when the automatic acquiring unit acquires the amount of deviation. In this configuration if using the amount of deviation by the automatic acquiring unit, the correction value that is specified by the amount of deviation acquired by the automatic acquiring unit is reconsidered. Therefore, it may be preferable to change the permissible range of the correction value accordingly.

In addition, the image forming unit may form images of a plurality of colors and the changing unit may be configured to determine a permissible range for each of the colors, independently. The permissible range can be set for each of the colors, so that it is possible to set the permissible range more appropriately.

What is claimed is:

1. An image forming apparatus comprising:

a manual acquiring unit which is configured to receive an input to acquire a correction value;

an image forming unit which is configured to form an image while adjusting at least one of positional deviation and density deviation of the image based on the correction value; and a changing unit which is configured to execute at least one of a first changing process of changing a permissible range of a correction value for positional deviation according to a status of a factor causing a change in a position of an image, and a second changing process of changing a permissible range of a correction value for density deviation according to a status of a factor causing a change in a density of an image, wherein the changing unit is configured to determine the permissible range by using a current correction value.

2. The image forming apparatus according to claim 1, further comprising:

a limiting unit which is configured to limit an input range of the correction value by the manual acquiring unit based on the permissible range.

3. The image forming apparatus according to claim 1, wherein the image forming unit is configured to print on a recording sheet a pattern image to be referred to when the input is received by the manual acquiring unit to acquire the correction value.

4. The image forming apparatus according to claim 3, wherein the image forming unit is configured to print a different pattern image according to the permissible range.

5. The image forming apparatus according to claim 1, further comprising:

an automatic acquiring unit which is configured to form a mark for detecting at least one of the positional deviation and the density deviation and to acquire an amount of deviation by measuring the mark, wherein the changing unit is configured to execute at least one of the first changing process and the second changing process when the automatic acquiring unit acquires the amount of deviation.

6. The image forming apparatus according to claim 1, wherein the image forming unit is configured to form images of a plurality of colors, and wherein the changing unit is configured to determine the permissible range for each of the colors, independently.

7. The image forming apparatus according to claim 1, wherein the factor includes one of a temperature, a humidity and an operation amount of the apparatus.

8. An image forming apparatus comprising:

a manual acquiring unit which is configured to receive an input to acquire a correction value;

an image forming unit which is configured to form an image while adjusting at least one of positional deviation and density deviation of the image based on the correction value;

a changing unit which is configured to execute at least one of a first changing process of changing a permissible range of a correction value for positional deviation according to a status of a factor causing a change in a position of an image, and a second changing process of changing a permissible range of a correction value for density deviation according to a status of a factor causing a change in a density of an image; and a limiting unit which is configured to limit an input range of the correction value by the manual acquiring unit based on the permissible range.

9. The image forming apparatus according to claim 8, wherein the image forming unit is configured to print on a recording sheet a pattern image to be referred to when the input is received by the manual acquiring unit to acquire the correction value.

10. The image forming apparatus according to claim 9, wherein the image forming unit is configured to print a different pattern image according to the permissible range.

11. The image forming apparatus according to claim 8, further comprising:

an automatic acquiring unit which is configured to form a mark for detecting at least one of the positional deviation and the density deviation and to acquire an amount of deviation by measuring the mark, wherein the changing unit is configured to execute at least one of the first changing process and the second changing process when the automatic acquiring unit acquires the amount of deviation.

12. The image forming apparatus according to claim 8, wherein the image forming unit is configured to form images of a plurality of colors, and wherein the changing unit is configured to determine the permissible range for each of the colors, independently.

13. The image forming apparatus according to claim 8, wherein the factor includes one of a temperature, a humidity and an operation amount of the apparatus.

* * * * *